United States Patent [19]

Bachmann et al.

[11] 4,003,767

[45] Jan. 18, 1977

[54] PROCEDURE FOR THE PRODUCTION OF PERMANENT MAGNETIC SINTER BODIES USING A TERNARY COBALT-LANTHANOID COMPOUND

[75] Inventors: Kurt Bachmann, Nussbaumen, Switzerland; Emanuel de Lamotte, Brussels, Belgium

[73] Assignee: BBC Brown Boveri & Company Limited, Baden, Switzerland

[22] Filed: Apr. 7, 1975

[21] Appl. No.: 565,561

Related U.S. Application Data

[63] Continuation of Ser. No. 303,595, Nov. 3, 1972, abandoned.

[30] Foreign Application Priority Data

Dec. 27, 1971 Switzerland ..... 18903/71

[52] U.S. Cl. ..... 148/105; 75/152; 148/103; 148/31.57

[51] Int. Cl.[2] ..... C21D 1/04; H01F 1/08

[58] Field of Search ..... 148/105, 103, 31.57; 75/152

[56] References Cited

UNITED STATES PATENTS

| | | | |
|---|---|---|---|
| 3,546,030 | 12/1970 | Buschow et al. | 148/31.57 |
| 3,682,714 | 8/1972 | Martin | 148/31.57 |
| 3,682,716 | 8/1972 | Martin et al. | 148/31.57 |
| 3,901,741 | 8/1975 | Benz et al. | 148/31.57 |

OTHER PUBLICATIONS

Das, D.; *Influence of Sintering Temp. on Mag. Prop. of Sm–Co Magnets*, in *IEEE Trans.*, Sept. 1971 pp. 432–435.

*Primary Examiner*—Walter R. Satterfield
*Attorney, Agent, or Firm*—Oblon, Fisher, Spivak, McClelland & Maier

[57] ABSTRACT

Permanent magnetic sinter bodies are formed by admixing a first binary alloy of cobalt and a first lanthanoid element, with particles of a second binary alloy of cobalt and a second lanthanoid element and thereafter magnetically aligning and sintering said particulate mixture.

3 Claims, No Drawings

PROCEDURE FOR THE PRODUCTION OF PERMANENT MAGNETIC SINTER BODIES USING A TERNARY COBALT-LANTHANOID COMPOUND

This is a continuation of application Ser. No. 303,595, filed Nov. 3, 1972, now abandoned.

BACKGROUND OF THE INVENTION

1. Field Of The Invention

This invention relates generally to the production of permanent magnetic sinter bodies.

2. Description Of The Prior Art

The binary alloys of the type $LnCo_5$, wherein Ln represents a lanthanoid, possess excellent characteristics as permanent magnets. These materials are generally characterized by extremely high remanence, high coercive force and high maximum energy product $(BH)_{max}$, and they exhibit a generally linear demagnetization curve (Sci. Am. December, 1970, pp. 92).

The binary alloy permanent magnets, however, are quite expensive, both in terms of cost of materials and in terms of cost of production, and they possess the undesirable characteristic of exhibiting a relatively high irreversible temperature coefficient at temperatures of above 250° C. These deficiencies are particularly applicable to the binary alloy $SmCo_5$, which in general has been recognized as possessing the most superior characteristics of the binary alloys.

Recent efforts directed to the development of alternative materials, in which samarium is completely or partly substituted with cheaper members of the lanthanoid series (see Martin-Benz, General Electric R & D Center, Schenectady, N.Y., Report No. 70-C-261, August, 1970), has revealed that ternary alloys, formed by substituting a less expensive lanthanoid element for the more expensive samarium, will possess better magnetic characteristics than those of the binary component of lesser magnetic qualities. For instance, it was found that $Sm_{0.5}Pr_{0.5}Co_5$ possesses better magnetic characteristics than $PrCo_5$.

Moreover, preliminary evidence suggests that the temperature coefficient of magnetization may be considerably reduced by appropriate selection of the lanthanoid elements used in the ternary alloy. It has also been recently demonstrated that exceptionally good coercive force can be obtained by using selected ternary alloys.

The desirability of the ternary lanthanoid-lanthanoid-cobalt alloys, is therefore well established. The procedures for preparing permanent magnetic sinter bodies of such alloys, however, has proven to be industrially unsatisfactory. In Martin-Benz, Supra., for instance, it is suggested to prepare these alloys by first mixing the elements in selected ratios, effecting alloying by metallurgical smelting, and then sintering the alloy. This technique, however, is particularly costly, especially if, as in many instances, it becomes necessary to vary the ratios of the ternary elements from batch to batch.

A need exists, therefore, for a technique of preparing ternary lanthanoid-lanthanoid-cobalt permanent magnetic sinter bodies in a more industrially advantageous manner.

SUMMARY OF THE INVENTION

Accordingly, it is one object of this invention to prepare magnetic sinter bodies by an industrially acceptable technique whereby the costs of production may be minimized and the mix ratio of the ternary elements in the bodies may be varied from batch to batch.

This and other objects of this invention, as will hereinafter become more readily understood by the following description, have been accomplished by the discovery that excellent permanent magnetic sinter bodies can be prepared by admixing a powdered binary alloy of cobalt and one of the two lanthanoid elements, with a powdered binary alloy of cobalt with the other of the two lanthanoid elements and sintering said powdered mixture.

DETAILED DESCRIPTION OF PREFERRED EMBODIMENTS

In the present invention binary cobalt-lanthanoid alloys are mixed in particulate form and subjected to sintering conditions to prepare a permanent magnetic sinter body. The term "lanthanoid" is intended to encompass the elements yttrium, lanthanum, and the lanthanides. The term "lanthanide" refers to those elements having atomic numbers of from 58 to 71. Also intended to be encompassed by the term "lanthanoid" is cerium mischmetal (MM), which is a cerium-rich alloy containing a considerable portion of lanthanum and or praseodymium.

The procedure of this invention is quite surprising in view of the fact that no immediate homogeneous alloy is formed. The permanent magnetic sinter bodies of this invention comprise a sintered mixture of binary particles of the structures $Ln^{(1)}Co_5$ and $Ln^{(2)}Co_5$ wherein $Ln^{(1)}$ represents one of the lanthanoid elements, and $Ln^{(2)}$ represents the other of the lanthanoid elements.

As broadly exemplary of this invention, and for explanatory purposes, in the present invention a sinter body corresponding to the ternary alloy $Sm_{0.5}Pr_{0.5}Co_{4.4}$ is prepared by first preparing a mixture of Sm $Co_{4.4}$ particles and Pr $Co_{4.4}$ particles. The particulate mixture is then subjected to sintering.

The binary alloys, $Ln^{(1)}Co_5$ and $Ln^{(2)}Co_5$ are prepared by conventional metallurgical sintering techniques. The alloys are then powdered into particle sizes of 1 to $10\mu$ either by a one step or multiple step comminuting operation. The alloy particles of the two lanthanoid elements are mixed and then sintered. Temperatures of between 800° and 1,350° C. may be used to effect sintering, which may require periods of at least 10 minutes to over 30 hours.

The constant magnetic sinter body product is obtained by known procedures of alignment, pressing and sintering. This sequence can be effected either by the procedure of DT-OS 1956 740 or by the procedure of DT-OS-2 121 514. In the former, the proportion of elements are selected so as to correspond to the formula of $Co_u Ln_x^{(1)} n_{1-x}^{(2)}$ wherein $3.5<u<5$, preferably 4.4 and $0<x<1$ prior to alignment, pressing and sintering. In the latter method, the proportion of the elements are mixed so as to correspond to the formula: $Co_5 Ln_x^{(1)} Ln_{1-x}^{(2)}$ prior to alignment, pressing and sintering. A cobalt-samarium alloy is added to the mixture as a sintering additive. The quantity of Sm may be from 46 to 65 weight percent, and the quantity of Co may be from 54 to 35 weight percent. The weight ratio of this additive in the total mixture to be sintered is choosen such that cobalt represents from 62–64 wt. % of the total weight.

Having now generally described the invention, a more detailed understanding can be obtained by reference to certain specific examples which are provided herein for purposes of illustration only and which are not intended to be limiting of the invention unless otherwise specifically specified:

EXAMPLE 1

Binary alloys $SmCo_5$ and $MMCo_5$ (cerium mixed metal-cobalt and an and Sm-Co alloy containing 60 percent by weight of samarium were melted and coarsely broken up to a grain size of about 1 mm. The alloys were then mixed in a proportion of 50 g.: 50 g.: 14 g. The mixture was then finely ground to obtain a grain size of 1 to 10$\mu$ to and the powder thus obtained was aligned at 50 kOe and 8 Mp/cm$^2$, hydrostatically pressed and the product sintered.

The sinter body thus obtained has a composition — after removal of the sinter additive — that can be said to correspond to the formula $Sm_{0.5}MM_{0.5}Co_5$.

EXAMPLE 2

Binary alloys $SmCo_5$ and $CeCo_5$ and a Sm-Co alloy with a 60 percent by weight of samarium component were melted and coarsely broken up to a grain size of about 1 mm. The alloys were mixed in proportions of 80.3 g.: 19.7 g.: 14 g. The mixture was then finely ground to a grain size of approximately 1 to 10$\mu$. The powder obtained was aligned at 50 kOe and 8 Mp/cm$^2$, hydrostatically pressed, and the ensuing product was sintered for 30 minutes at 1,095° C. The sinterbody thus obtained had a composition — after removal of the sinter additive — which can be said to correspond to $Sm_{0.8}Ce_{0.2}Co_5$.

| The sinterbody had the following characteristics: | |
|---|---|
| Density | = 8.25 g/cm$^3$ |
| Remanence | = 8600 gauss |
| coercive force $_BH_c$ | = 7500 Oe |
| coercive force $_iH_c$ | = 11650 Oe |
| Maximum energy product $(BH)_{max}$ | = 17.8 MGOe |

The characteristics of sinterbodies obtained in Examples 1 and 2 were identical with those derived from magnetic bodies, prepared from homogeneous molten alloys, $Sm_{0.5}MM_{0.5}Co_5$ or $Sm_{0.8}Ce_{0.2}Co_5$.

The procedure of this invention results in materials having better magnetic characteristics as ternary compounds, than those of the binary component which make up the product, which each have lesser magnetism. The values of magnets $Sm_{0.5}MM_{0.5}Co_5$ and $Sm_{0.8}Ce_{0.2}Co_5$ for instance, prepared according to the new procedure are better than those of magnets $MMCo_5$ or $CeCo_5$ taken individually. The procedure of this invention not only reduces the costs of production, but allows for simple variations in the magnet alloy, since there are only a few Ln-Co alloys required as key alloys.

Having now fully described the invention, it will be apparent to one of ordinary skill in the art that many changes and modifications can be made thereto without departing from the spirit or scope of the invention as set forth herein.

Accordingly, what is claimed and intended to be covered by Letters Patent is:

1. A method for producing a permanent magnetic sinter body which comprises:

a. admixing particles of a first binary alloy of cobalt and a first lanthanoid element, $Ln^{(1)}$, having the formula $Co_5Ln^{(1)}$ with particles of a second binary alloy of cobalt and a second lanthanoid element, $Ln^{(2)}$, having the formula $Co_5Ln^{(2)}$, b. admixing a different cobalt-samarium alloy with said first and said second binary alloys of cobalt as a sintering additive, c. and thereafter sintering at a temperature 800° – 1350° C, said particulate mixture, whereby a permanent magnet is formed, wherein said lanthanoid elements $Ln^{(1)}$ and $Ln^{(2)}$ are different from one another and are selected from the group consisting of yttrium, lanthanum and lanthanoid having an atomic number of 58 to 71; wherein the ratios of the binary alloys are selected so that the proportion of the elements in said sintered body correspond to the formula $Co_uLn_x^{(1)}Ln_{1-x}^{(2)}$, wherein $3.5<u<5$ and $0<x<1$; said cobalt-samarium alloy being composed of 46–65% by weight samarium and 54–35% by weight of cobalt based on the total weight of the alloy, and wherein the weight ratio of said sintering additive is chosen such that the total content of the cobalt in the final mixture is 62–64 wt. percent.

2. The process of claim 1, wherein the metallurgically smelted binary alloys comprise of $SmCo_5$, $MMCo_5$ and SmCo, wherein the weight ratio of Sm/Co is 60/40 and wherein said alloys are coarsely comminuted to grain sizes of about 1 mm, mixed in a weight ratio of 50:50:14, and then finely comminuted to a grain size of from 1 to 10$\mu$, aligned, pressed and sintered.

3. The process of claim 1, wherein metallurgically smelted binary alloys comprise $SmCo_5$, $CeCo_5$, and SmCo, wherein the weight of Sm/Co is 60/40 and wherein said alloys are coarsely comminuted to a grain size of about 1 mm, mixed in a weight ratio of 80:20:14 and then finely comminuted to a grain size of about 1 to 10 $\mu$, aligned, pressed and sintered.

* * * * *